US005081734A

United States Patent [19]

Sandford et al.

[11] Patent Number: 5,081,734

[45] Date of Patent: Jan. 21, 1992

[54] FLOOR SCRAPING MACHINE

[75] Inventors: Reginald E. Sandford; Robert R. Alexander, both of Victoria, Canada

[73] Assignee: The Re Partnership, Victoria, Canada

[21] Appl. No.: 593,987

[22] Filed: Oct. 9, 1990

[51] Int. Cl.[5] ..... A47L 11/14; A47L 13/08; B26B 25/00

[52] U.S. Cl. ..... 15/93.1; 15/236.1; 29/81.11; 30/477; 51/177

[58] Field of Search ..... 15/93.1, 180, 236.1; 299/41; 29/81, 05, 81.11; 125/5; 144/118; 51/177; 30/172, 477

[56] References Cited

U.S. PATENT DOCUMENTS 1,228,476 6/1917 Ponselle ..... 30/477
1,694,737 12/1928 Finnell ..... 15/180
2,101,394 12/1937 Johnson ..... 15/93.1
2,453,371 11/1948 Hobson ..... 15/93.1
4,219,898 9/1980 Presby ..... 15/180
4,295,274 10/1981 Bricher et al. ..... 299/41
4,531,253 7/1985 Cottam ..... 15/236.1
4,614,380 9/1986 Allen ..... 299/41

*Primary Examiner*—Edward L. Roberts
*Attorney, Agent, or Firm*—Shlesinger, Arkwright & Garvey

[57] ABSTRACT

A floor scraping machine includes a mounting plate rotatable about a vertical axis with a plurality of blade holding assemblies. Each assembly includes a blade mount for securing a scarfing blade, and a biasing means acting on the mount for urging the mount with the blade to manually adjustable bias position below the mounting plate. Also, the biasing force acting on each blade mount may be adjusted.

7 Claims, 3 Drawing Sheets

FLOOR SCRAPING MACHINE

FIELD OF THE INVENTION

This invention relates to floor scraping machines, the general purpose of which is to prepare floors for surfacing, resurfacing or covering by the removal of old adhesive, paint, wax, rubber and like material.

BACKGROUND TO THE INVENTION

The need for machines to scrape or abrade floors to remove adhered waste material is well defined and, as is noted in U.S. Pat. No. 4,486,931 (Pichelman et al) granted on Dec. 11, 1984, various machines have been developed for this purpose. The particular example of Pichelman et al teaches the use of a large number of scarifying discs mounted vertically on a circular plate that rotates in a horizontal plane. The discs, with abrading peripheries that engage the floor, rotate in vertical planes. Noting earlier designs working on the scarifying disc principle, Pichelman et al also noted a tendency of such designs to "buck"-an undesirable feature because a floor can be gouged and damaged as a result. They address the problem, in part, by lowering the centre of gravity of rotating parts in their own design.

Other examples of floor scraping machines include the use of numerous wire blades organized in groups beneath a circular plate to provide a brush-like cutting action as the plate rotates: see U.S. Pat. No. 4,385,412 granted to Neufeldt on May 31, 1983. There is no comment on any tendency that the design may have to buck, but this, as well the effectiveness of the scraping action, may depend on the relative stiffness of the wire blades.

Machines calling for the use of a large number of rotary discs as in the case of Pichelman et al or a large number of wire blades as in the case of Neufeldt can be considered undesirable from a cost or maintenance point of view. In addition to purchase cost, the blade or scraping elements require more work to remove or install, and more work to service.

An example of a machine that could be used as a floor scraping machine even though it is not described as such may be found in U.S. Pat. No. 3,613,147 granted to Norfleet on Oct. 19, 1971. Norfleet describes a wall scraper tool in the nature of an accessory attachment for a hand-held power drill. The attachment includes four rigidly positioned scraper blades projecting below a circular plate. As the plate rotates, the blades perform a scraping action. Rollers are spaced around the periphery of the plate and, while their purpose is not clearly stated, it is likely that they are intended to limit gouging that might occur if the tool wobbles or bucks when in use.

In the design of prior art floor scraping machines, the action of cutting blades and the like is largely fixed and predetermined. There is no means for dynamic selfadjustment in response to changing operating conditions. This is believed to contribute to the tendency of such machines to gouge or become unstable. As well it limits the ability of the machine to accommodate uneven floor surfaces.

Accordingly, a primary object of the present invention is to provide a new and improved floor scraping machine that adjusts dynamically in response to changing operating conditions so as to lessen the possibility of damage to the floor or to the machine itself. (Machine damage can occur if, for example, a blade encounters an obstruction such as a nail or other hard object protruding from the floor).

A further object of the present invention is to provide a new and improved floor scraping machine that not only adjusts dynamically in response to changing floor conditions, but which may also be easily adjusted manually to preset cutting blades for pressure and depth of cut.

BRIEF SUMMARY OF THE INVENTION

In accordance with a broad aspect of the present invention, there is provided a floor scraping machine comprising a mounting plate rotatable about a vertical axis and a plurality of blade holding assemblies each independently mounted to the platefor rotation therewith. Each blade holding assembly includes a blade mount for securing a scarfing blade to the assembly in a floor scraping position, and a biasing means acting with a biasing force on the mount for urging the mount with the blade to a manually adjustable bias position below the plate. A drive means serves to rotate the mounting plate about its axis such that the blades then scrape the floor. In a preferred embodiment, each blade holding assembly includes a bar member, one end of which carries the scarfing blade, the other end being hingedly mounted to the mounting plate for pivotal movement about a horizontal hinge axis. In this embodiment, a biasing means (preferably relying on a simple compression spring) applies a biasing force to the bar member urging the member with the blade to a pivotal bias position below the plate.

Advantageously, the biasing means of each blade holding assembly may include means for manually adjusting the associated biasing force thereby permitting blade pressure and depth of cut to be preset.

The invention will now be described with reference to the drawings.

DETAILED DESCRIPTION

Figure 1:
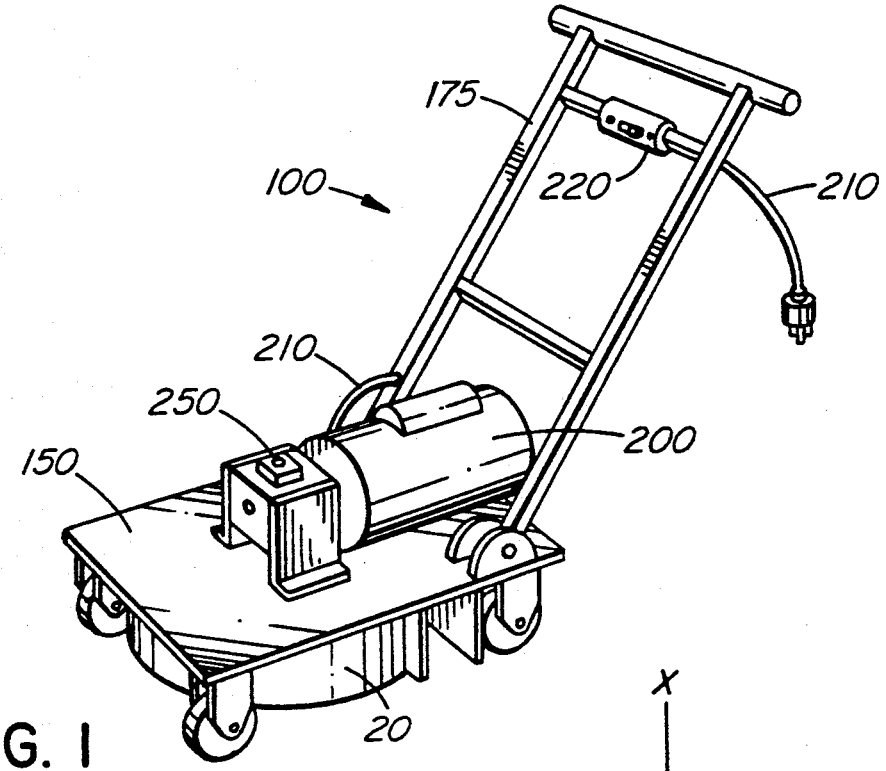
FIG. 1 is a perspective view of a floor scraping machine that embodies the present invention.

The floor scraping machine generally designated 100 in FIG. 1 includes a wheeled carrier frame or deck 150 on which is mounted an electric motor 200, a drive box 250, and an operator handle 175. The output drive (not shown) of motor 200 is coupled in a conventional manner through a vertical base gear drive or drive box 250 to vertical drive shaft 4 (see FIG. 2) which in turn is coupled to circular mounting base plate 20 carried beneath deck 150. Electric operating power is derived from a suitable external source which is fed through power cord 210 via an on-off switch 220 to motor 200.

Detailed structural aspects of deck 150, handle 175, motor 200 and the means by which motor 200 is powered, and the manner in which shaft 4 is coupled to motor 200 by drive box 250, may be highly variable. Their design will be readily apparent to those skilled in the art, and a more detailed description will not be provided here. However, it may be noted that the overall design represented by machine 100 has worked very well utilizing a 1 horsepower, 1725 rpm motor manufactured by Leeson Electric Corporation of Grafton, Wis., for motor 200 and, for drive box 250, a FLEXALINE TM Model No. 1133 vertical base worm gear 5:1 speed reducer made by the Grove Gear Division of Regal-Benoit Corporation, Union Grove, Wis. Power input to the motor was 110 VAC. The output of the speed reducer was at about 360 rpm.

Figure 2:
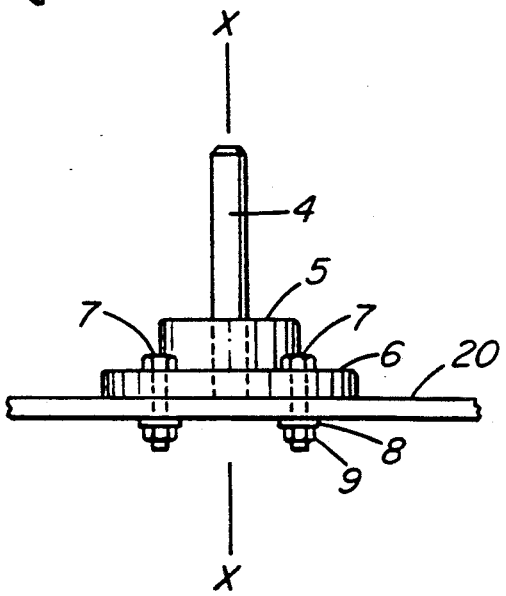
FIG. 2 is an elevation view, partially cut-away, showing the rotation drive coupling to the mounting plate of FIG. 1.
Figure 3:
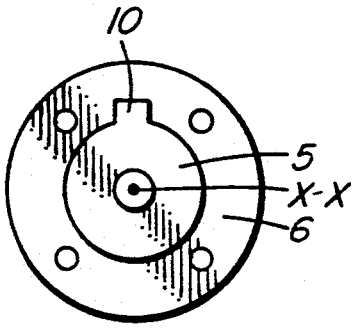
FIG. 3 is a top view of the mounting flange shown in FIG. 2.

Shaft 4, which rotates about a vertical axis X—X as shown in FIG. 2, is coupled to mounting plate 20 by means of circular flange 5; the lower portion 6 of flange 5 being bolted to plate 20 using four bolts 7 with lockwashers 8 and nuts 9. As seen in FIG. 3, flange 5 includes a key slot 10 for engaging a keying flange (not shown) on the lower end of shaft 4.

As shaft 4 rotates about vertical axis X—X, mounting plate 20 likewise rotates about axis X—X.

Figure 4:
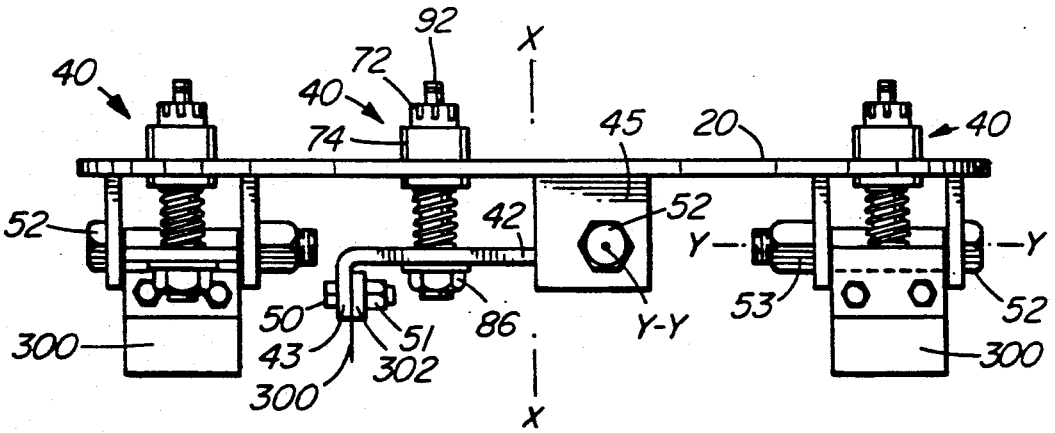
FIG. 4 is an elevation view of the mounting plate in FIG. 1 showing three of four blade holding assemblies carried by the plate.
Figure 5:
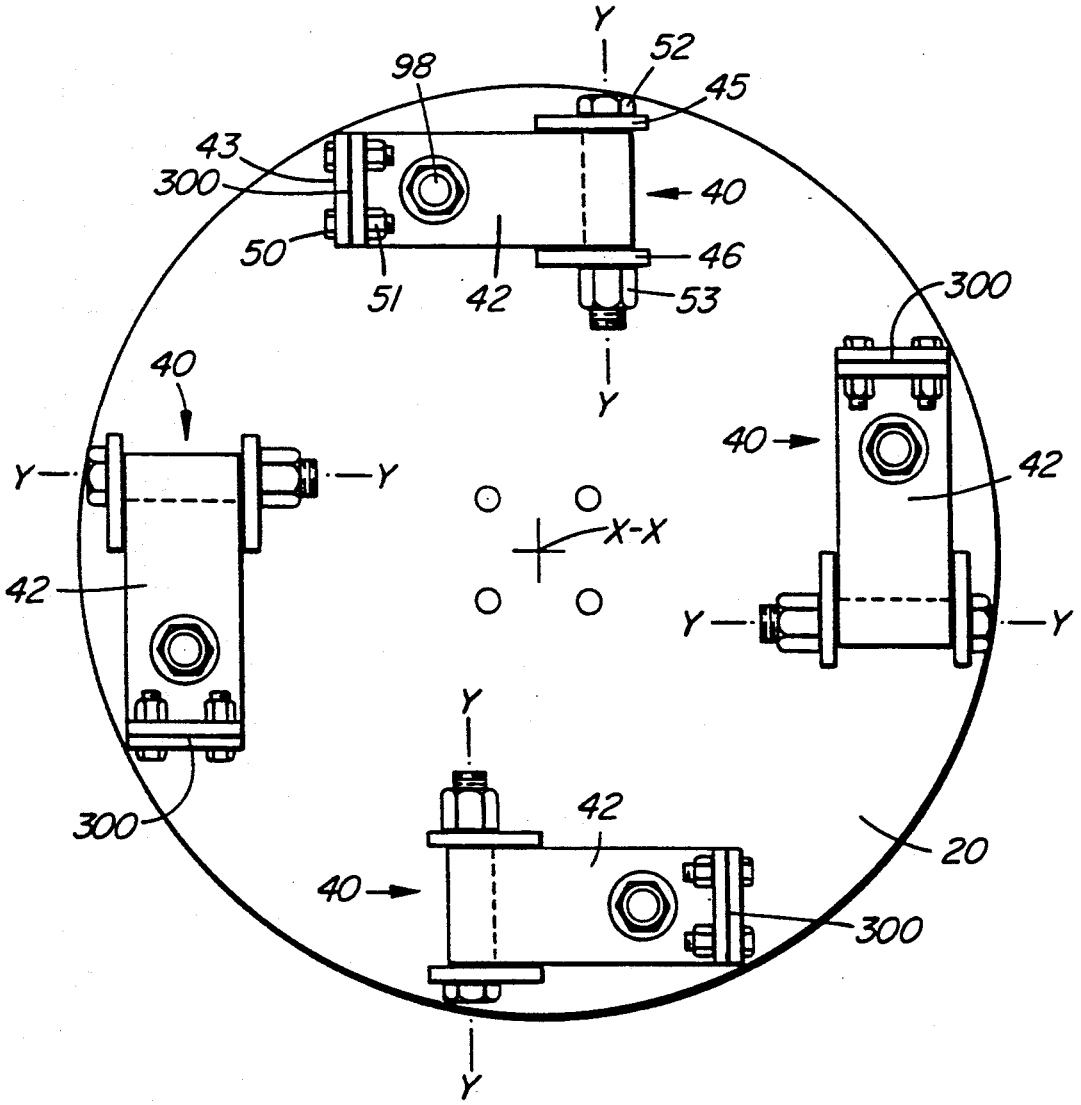
FIG. 5 is a bottom view of the mounting plate in FIG. 1 showing all blade holding assemblies carried by the plate.

Referring now to FIG. 5, it can be seen that four blade holding assemblies, each generally designated 40, are carried beneath plate 20. Three of these assemblies are shown in FIG. 4. A portion of these assemblies is shown in more detail in FIG. 6. The assemblies are positioned around axis X—X at 90° intervals and are equidistant from the axis.

Each assembly 40 includes a bar member 42 which serves as a blade mount for securing a vertically oriented scarfing blade 300 (preferably fabricated from spring steel) to one end 43 of member 42 below plate 20 in a floor scraping position. Each blade 300 is removably secured by means of a pair of bolts 50 and lockwasher nuts 51. Such removability facilitates blade maintenance and blade replacement. A flat bar 302 is held across the top face of each blade 300 by bolts 50 and nuts 51 to provide added strength to the blade mount.

Using a hinge bolt 52 and a non-slip fibre nut 53, the end 44 opposed to blade end 43 of each bar member is hingedly mounted to plate 20 between a pair of hinge plates 45, 46 for pivotal movement about a horizontal hinge axis Y—Y.

Figure 6:
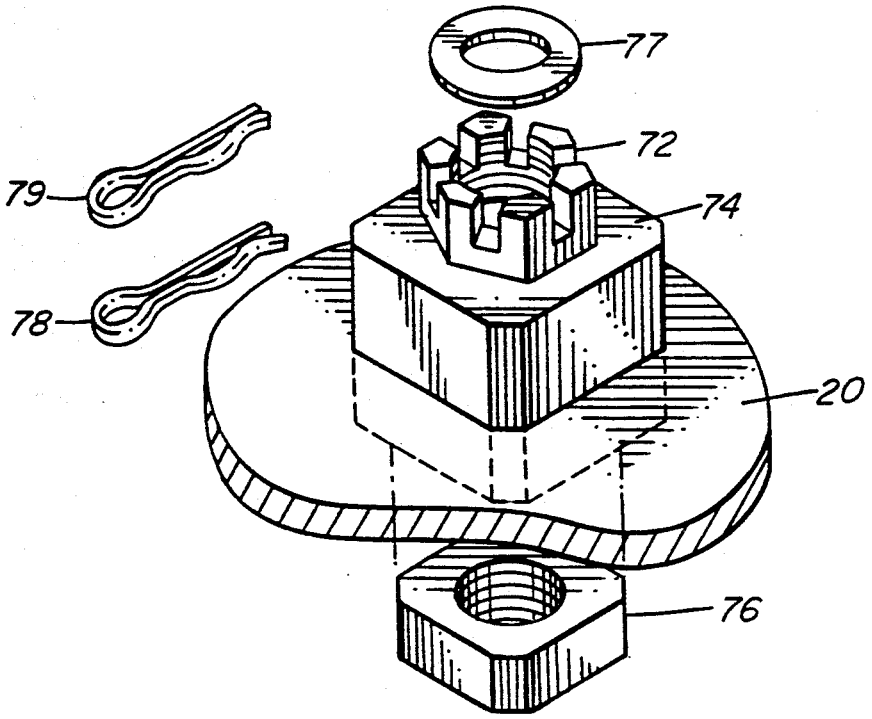
FIG. 6 is an exploded perspective view, showing additional elements, and partially cut-away, of the retaining and biasing assembly for one of the blade holding assemblies shown in FIG. 4.
Figure 6:
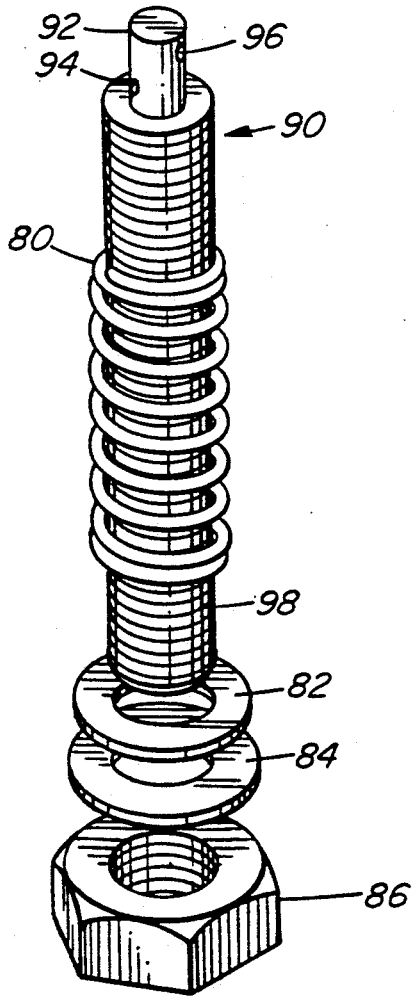

Retention and control of the pivotal movement of each bar member 42 is provided by a retaining and biasing assembly 70 shown in exploded detail in FIG. 6. Each assembly 70 includes a retainer bolt generally designated 90 which is threaded along most of its length except upper end 92. Bolt 90, with bar member 42 sandwiched between washers 82 and 84, extends upwardly and slidingly through member 42, through the longitudinal centre of spring 80 and into and through an alignment housing 74, the latter of which itself extends through and is welded in position to mounting plate 20.

Within housing 74, bolt 90 is threaded through square nut 76 which is slidingly received by the housing. Above nut 76, upper end 92 of bolt 90 extends upwardly through castlegate nut 72 which is welded to the top of housing 74.

Cotter key 78, when inserted through hole 94 of bolt 90, and also engaging a gate of castlegate nut 72, normally secures bolt 90 against turning after a pressure adjustment is made. A second hole 96 (above hole 94) in upper end 92 of bolt 90 is provided to receive a second cotter key 79 at a position above washer 77 which normally sits on top of castlegate nut 72. When cotter key is positioned through hole 96. If cotter key 78 is removed, then bolt 90 will drop to the point where the underside of key 79 resides on top of washer 77 which holds key 79 away from an engagement with castlegate nut 72. Bolt 90 may then be turned in nut 76 to provide a pressure adjustment.

During normal use, nut 86 is threaded on the lower end 98 of bolt 90. This secures bar member 42, spring 80 and washers 82 and 84 from simply dropping off bolt 90. Also, as is described below, nut 86 is an integral part of the blade adjustment features for machine 100.

Spring 80, acting at one end on nut 76 and at the other end on washer 82, is normally in compression between mounting plate 20 and bar member 42. Apart from the spacing provided by washer 84, member 42 is normally urged by the biasing force of spring 80 to the vertical adjusted height of nut 86 on bolt 90.

The vertical adjusted height of nut 86 on bolt 90 determines the bias position of bar member 42 and blade 300, and primarily serves to adjust the cutting depth of blade. The lower the height, the greater the depth. Concurrently, for a given cutting depth adjustment, the vertical adjusted height of square nut 76 on bolt 90 primarily serves to control blade pressure by fixing the static degree of spring compression. The lower the height of nut 76, or the closer its proximity to nut 86, the greater the degree of compression.

It will be appreciated that with the ability to adjust both blade cutting depth and blade pressure the adaptability of machine 100 to different floor surface conditions is greatly enhanced. The machine is suitable for either concrete or wood floors. Before operation commences, adjustment for a basic static or average condition can be made. After operation commences, and as an operator moves the machine over a floor area, the dynamic compressiblity and resilience of the springs 80 serves to provide a shock absorbing effect that smooths performance and makes the machine less susceptible to uneven floor surfaces or other dynamically changing conditions. In extreme cases where, for example, nails may be encountered protruding up from a floor, the blades will tend to simply bounce over the obstruction without significant damage to the blade and without kickback to the machine. Of course, it will be recognized that this desirable behaviour has limits, but the operation has been found to be much improved over the performance of machines with rigidly mounted blades.

Various modifications and changes to the particular embodiment that has been described are possible and will undoubtedly occur to those skilled in the art. For example, although four blade holding assemblies 40 are used with machine 100, it would be possible to use a fewer or greater number of such assemblies. However, with the use of four such assemblies, it has been found that a rapid and efficient scraping action can be achieved, and that required blade maintenance is easily managed. Likewise, it is contemplated that it would be possible to use a different blade mounting and biasing arrangement, the hinged arrangement with a compression spring being attractive by reason of its simplicity of construction from readily available or easily made parts, and by reason of the ease of adjustment for blade cutting depth and blade pressure. With the hinged blade arrangement of machine 100, a significant amount of blade wear can occur without the need for blade replacement. As well, the blades cannot easily be driven out of adjustment.

The foregoing and other possible changes or alterations are considered to fall within the spirit and scope of the following claims.

We claim:

1. A floor scraping machine, comprising:

(a) a mounting plate rotatable about a vertical axis;

(b) a plurality of blade holding assemblies each independently mounted to said plate for rotation therewith, each assembly including:

(i) a blade mount for securing a scarfing blade to the assembly below said plate in a floor scraping position; and (ii) biasing means acting with a biasing force on said mount for nonrigidly urging said mount with said blade to a bias position below said plate;

(iii) means for manually adjusting the bias position of the associated blade and, (c) drive means for rotating said mounting plate about said axis.

2. A floor scraping machine as defined in claim 1, the biasing means of each blade holding assembly including means for manually adjusting the associated said biasing force.

3. A floor scraping machine as defined in claim 1 or 2, said blade holding assemblies being carried by said plate at equal spaced angles around and equidistant from said vertical axis.

4. A floor scraping machine, comprising:

(a) a circular mounting plate rotatable about a vertical axis;

(b) a plurality of blade holding assemblies each independently mounted to said plate for rotation therewith, each assembly including:

(i) a bar member having opposed ends, one end being hingedly mounted to said plate for pivotal movement about a horizontal hinge axis, the opposed end including means for securing a scarfing blade to said bar in a floor scraping position; and (ii) biasing means acting with a biasing force on said bar member for non-rigidly urging said member with said blade to a pivotal bias position below said plate;

(iii) means for manually adjusted the bias position of the associated blade and, (c) drive means for rotating said mounting plate about said axis.

5. A floor scraping machine as defined in claim 4 the biasing means of each blade holding assembly comprising a compression spring acting between said plate and the associated bar member.

6. A floor scraping machine as defined in claim 5 including means for adjusting the static degree of compression of said spring of each said blade holding assembly to vary the biasing force acting on the associated bar member.

7. A floor scraping machine as defined in claim 5, or 6, said blade holding assemblies being carried by said plate at equal spaced angles around and equidistant from said vertical axis.

* * * * *

UNITED STATES PATENT AND TRADEMARK OFFICE

CERTIFICATE OF CORRECTION

PATENT NO. : 5,081,734

DATED : January 21, 1992

INVENTOR(S) : Reginald E. Sandford et al.

It is certified that error appears in the above-identified patent and that said Letters Patent is hereby corrected as shown below:

Claims 1 and 4 should read as follows:

Column 5

Claim 1, line 8, after "position;" delete "and";
, line 12, after "plate" insert --and--; and
, line 14, after "blade" insert --;--.

Column 6

Claim 4, line 11, after "bar" insert --member--;
, line 12, after "position" delete "and";
, line 16, after "plate;" insert --and--; and
,line 17, change "adjusted" to --adjusting--.

Signed and Sealed this

Twenty-eighth Day of December, 1993

*Attest:*

Bruce Lehman

BRUCE LEHMAN

*Attesting Officer*

*Commissioner of Patents and Trademarks*